United States Patent [19]

Lenk

[11] 3,958,473

[45] May 25, 1976

[54] APPARATUS FOR ELIMINATING FILAMENTARY WINDERS

[75] Inventor: Erich Lenk, Remscheid-Lennep, Germany

[73] Assignee: Barmag Barmer Maschinenfabrik Aktiengesellschaft, Wuppertal, Germany

[22] Filed: June 18, 1975

[21] Appl. No.: 587,979

[30] Foreign Application Priority Data

June 18, 1974 Germany ..... 2429055

[52] U.S. Cl. ..... 83/98; 83/353; 83/355; 83/360; 83/522; 83/614; 83/628; 83/631

[51] Int. Cl.[2] ..... B26D 5/22

[58] Field of Search ..... 83/98, 353, 355, 360, 83/522, 614, 631, 628, 565, 924, 909

[56] References Cited

UNITED STATES PATENTS

| | | | |
|---|---|---|---|
| 1,635,531 | 7/1927 | Brundage | 83/353 |
| 1,967,486 | 7/1934 | Vennewitz | 83/353 |
| 2,620,993 | 12/1952 | Jeffrey, Jr. | 83/614 X |
| 2,936,664 | 5/1960 | Myers | 83/614 X |
| 3,365,992 | 1/1968 | Dreher | 83/614 |

*Primary Examiner*—Frank T. Yost
*Attorney, Agent, or Firm*—Johnston, Keil, Thompson & Shurtleff

[57] ABSTRACT

A device for eliminating filamentary winders from the surface of a rotating working roller of the type commonly utilized in the textile industry. A runner carrying a cutting means is provided which moves traversely over the surface of the working roller and parallel to its axis. The runner may be driven by either a guide groove formed in the surface of the working roller or a separate reverse-winding roller which is linked to the working roller. The cutting means may comprise a wedge-shaped blade edge facing the running direction of the working roller which has a blunted projecting portion which extends slightly below the surface of the working roller and which initially engages any winder encountered thereon. In addition an electrical means for detecting, counting and/or allocating winders to discrete length sections of the working roller may be provided which is operated by the cutting means. An air nozzle mounted adjacent to the cutting means is also provided which generates an aimed flow of air which removes the cut winders from the surface of the working roller in the direction of the running-off thread.

11 Claims, 6 Drawing Figures

FIG. 1
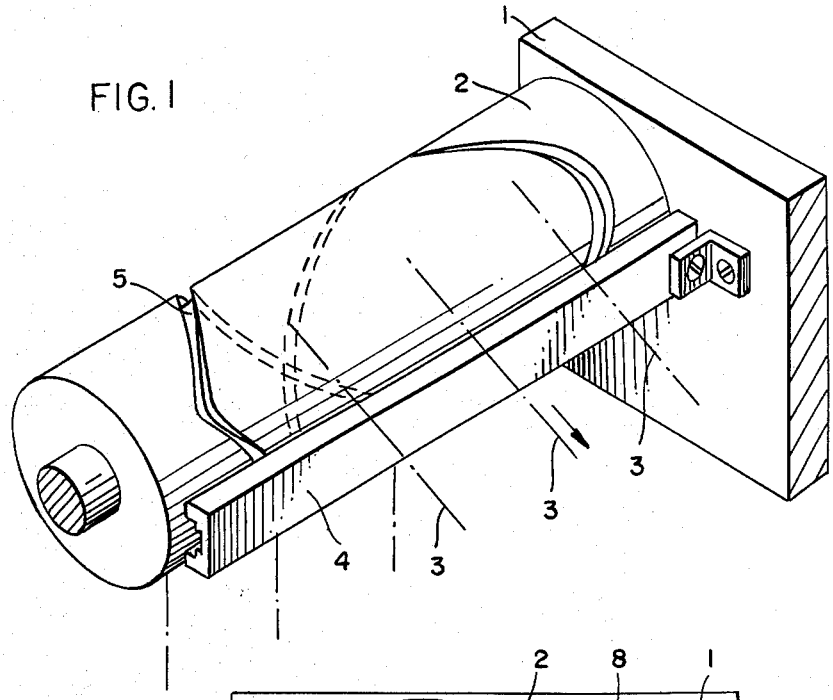
FIG. 2
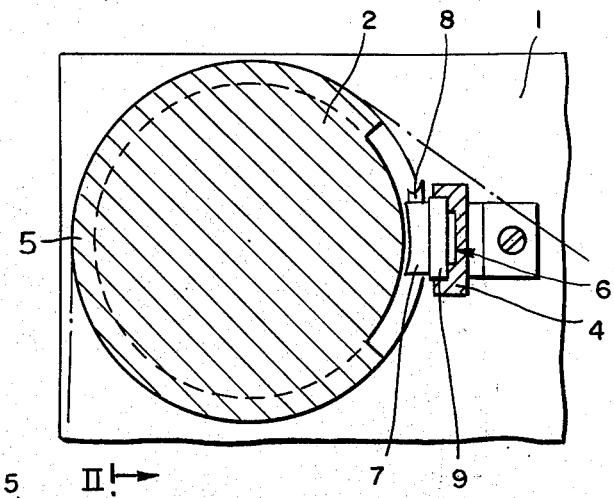
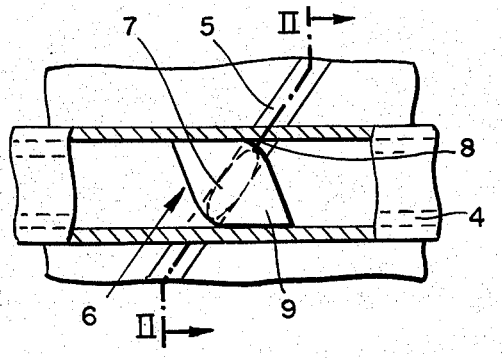
FIG. 3

APPARATUS FOR ELIMINATING FILAMENTARY WINDERS

INTRODUCTION

The present invention relates to a device for eliminating filamentary winders on a rotating working roller, and more particularly, on stretching mechanisms for yarns, threads, bands or the like, which are commonly utilized in the textile industry.

BACKGROUND OF THE INVENTION

Rotating working rollers of the type which the present invention relates are generally utilized to process and/or convey endless thread-type materials. Examples of such rollers are delivery cylinders, godets or rollers in stretching mechanisms, and conveyor rollers.

From German patent DT-PS 885,908 there is known a device that prevents undesired winding of threads on rotating rollers. In this device the rotating roller is scanned by a beam of light and the reflection or absorption of the light by the roller is measured. When a winder occurs, an electrical signal is produced by a photoelectric cell, which may be utilized to stop the drive of the roller.

This known arrangement has been found to be disadvantageous in that it does not eliminate the undesired winding of individual threads on the rotating roller, but only prevents major damage to the machine by bringing the rotating roller to a standstill. Hence, the continuously running work process is interrupted until the winder is manually eliminated by the operating personnel.

German laid-open application DT-AS 1,079,513 and DT-AS 1,510,725 disclose fiber strippers on the stretching mechanism and delivery cylinders. These fiber strippers or clean-up devices strip off individual threads or fibers that have separated from the thread bundle for such reasons as electrostatic charging of the fibers which causes them to adhere to the rotating roller and the like. However, the functional capacity of such thread strippers or clean-up devices is restricted to low thread deniers and low conveyance speeds of the yarns or threads to be worked. Therefore, these devices are not suited for automatically removing winders from working rollers in high speed operations for a wide variety of thread types.

BRIEF DESCRIPTION OF THE INVENTION

The present invention solves the problems associated with the above described devices by providing a reliable apparatus for the automatic elimination of filamentary winders from rotating rollers as they arise or immediately thereafter, and by which the operational interruptions heretofore experienced with such devices is eliminated. In addition, the present invention may be utilized with a wide variety of thread types having high denier and with a large number of individual filaments such as where several different threads are to be worked simultaneously. Furthermore, the present invention prevents the collection of stripped-off winders or fibers in the zone of the working roller which may lead to operational interruptions due to fouling of the mechanism by this excess stowage material.

In accordance with the present invention, there is provided a traveler or runner carrying a cutting means which cooperates with the surface of the working roller. As the working roller turns, the runner moves traversely across the surface and parallel to its axis. The traverse stroke of the runner extends across the entire length of the working roller and the cutting means is thereby brought into contact with any winders or threads that may be adhering to its surface. Therefore, all winders or yarn laps adhering to the surface of the working roller will be severed each time the runner and cutting means completes a traverse stroke across the length of the working roller. Since the time for this traverse stroke is relatively short — requiring but a few revolutions of the working roller — at most only a few layers of winders or threads will have the opportunity to wrap around the working roller.

In the event that a working roller has been provided with a surface coating not suited for guiding a runner — for example, a rubber-coated roller or a roller covered with an elastic plastic material or the like — the runner is preferably driven by a separate reverse-winding roller or a groove roller. In such cases, the drive for the working roller is mechanically coupled with the drive of the reverse-winding roller so that the ratio of the rate of revolutions (RPM) of the working roller to the number of the double strokes per unit of time of the runner is, in correspondence to the criterion for a "mirror formation", a whole number. Hence, the cutting means will be guided in a single, constantly recurring track curve, thereby avoiding destruction of the coated surface of the working roller by a large number of adjacently lying grooves or phase-displaced path curves.

However, in another preferred embodiment of the invention, the working roller itself is constructed with the guidance groove formed in its surface. Such an embodiment is especially advantageous when the working roller has a hard surface, such as steel or the like which is suited for guiding the runner and cutting means, and has a ratio of length to diameter sufficient to cut a suitable guide groove therein. In such cases, the diameter of the working roller must be at least large enough so that its functioning is not affected by the cut of the guide groove. Also, the pitch angle of the guide groove must be large enough so that the crossing angle between guide groove and thread is not too flat so as to interfere with the running of the thread over the surface of the roller. In such an embodiment, a separate drive for the runner and cutting means is not required, since the runner will slide within the guidance groove formed in the working roller, thereby propelling the cutting means across its surface within the confines of a traverse guide. Since an additional runner and cutting means drive mechanism is obviated in such an embodiment, mechanical expenditure for the apparatus is greatly reduced.

Collection of stripped-off winders in the zone of the working rollers is prevented by providing the cutting means with a blade edge which runs under and slightly lifts the filamentary winder off at the working roller surface before it is severed. As soon as the filamentary winder has been cut through, its free end is engaged by a directed air stream and blown away from the surface of the working roller in the direction of the running-off thread and is conveyed onward by this tread-out of the apparatus. In such an embodiment, the cutting means may be provided with compressed air nozzles which may be supplied from a suitable compressed air source through a flexible hose connection.

In many areas of use, it is not sufficient to merely automatically eliminate undesirable filamentary winders. In order to monitor the quality of the products so produced, it is also necessary to be able to determine the frequency of filamentary winders or thread breaks and to know where they have occurred. It is desirable, therefore, to detect filamentary winders or thread breaks, and to indicate them to the operating personnel optically or acoustically, and in the case of automatic operation, to detect such filamentary winders or thread breaks for discrete working zones of the roller and store this information in a suitable signalized form. Through correlation of this information with the peripheral velocity of the working rollers or the working speed, the quality of the worked thread cable can be judged quantitative — for example, as a function of threadbreaks per 1000 meters of running thread length.

A particular embodiment of the present invention is shown as being fitted with a means for detecting and signalling filamentary winders. In this embodiment, the cutting means itself is constructed as contactor or impulse generator by fastening it resiliently on the runner, whereby variations of its spring tension or its deflection from a normal cutting position as filamentary winders are encountered will engage a contact of a microswitch, thereby signalizing an electric circuit.

DESCRIPTION OF THE DRAWINGS

FIG. 1 is a perspective view of an apparatus for filamentary winders constructed in accordance with an embodiment of the present invention;

FIG. 2 is a cross-sectional view of the structure shown in FIG. 1 corresponding to the section line II—II in FIG. 3;

FIG. 3 is an enlarged fragmentary view of a portion of the structure shown in FIG. 1;

DESCRIPTION OF THE PREFERRED EMBODIMENT

Figure 4:
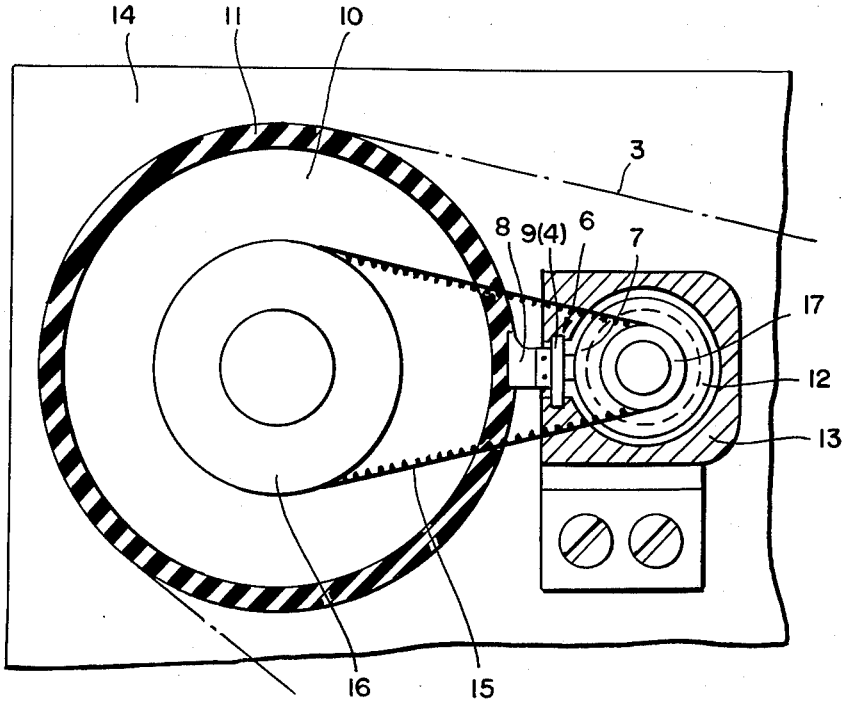
FIG. 4 is a cross-sectional view similar to FIG. 2 showing an alternate embodiment of the present invention.

FIG. 1 illustrates an embodiment of an apparatus for eliminating filamentary winders constructed in accordance with the present invention. On machine frame 1 there is rotatably mounted a working roller 2 which is driven by means (not shown) on the back of the machine frame. Working roller 2 may be, for example, part of a stretching mechanism for several threads or yarns 3 lying adjacent to one another and which are to be worked simultaneously.

The apparatus of the present invention for the automatic elimination of filamentary winders basically comprises traverse guide 4 mounted on machine frame 1 parallel to the axis of working roller 2 and a runner 6 cooperating with the surface of working roller 2 and which is traversed back and forth in guide 4. For the drive of rubber 6, there is provided in the surface of the working roller 2 an endless winding guide groove 5, which is suited for guiding shuttle body 7 on runner 6. The pitch of the winding guide groove 5 is such that the angle formed between a winder formed on the periphery of the working roller and cutting means 8 of runner 6 is as great as possible. This arrangement yields a high axial traverse speed for runner 6 and a correspondingly lower winder buildup. However, the frictional relationship between the guide groove and the sides of the driven shuttle body 7 limit the maximal size of the pitch angle of the guide groove since a too shallow pitch angle will severely impair the movement of the shuttle body and increase the surface pressure applied by working roller. In actual practice it is recommended that the pitch angle of the guide groove be between 30° and at most 60°, preferably less than 45°.

FIGS. 2 and 3 show in cross section the device illustrated in FIG. 1 and a fragmentary view of runner 6 traversing in guide groove 5 cut in the surface of working roller 2. Shuttle body 7 on runner 6 carries a cutting means 8. On rotation of the working roller, shuttle body 7 is positively driven within guide groove 5 and connected guide plate 9 is moved back and forth in guide 4.

In order to eliminate filamentary winders, shuttle body 7 has mounted therein a cutting means 8 which acts in at least one running direction. This cutting means is preferably constructed in such a manner that a blunted part of the blade is guided within guide groove 5 and will run under the winder formed on the periphery of the working roller in order to sever it under a slightly increased tension in the zone of the sharpened blade edge.

While FIGS. 1 to 3 represent an operational example in which a guide groove 5 is cut in the mantle surface of the working roller 2, within which runner 6 consisting of the shuttle body 7, cutting means 8 and a lozenge-shaped guide plate 9 is driven, FIG. 4 represents another embodiment in which the surface coating or layer 11 of working roller 10 is unsuited for the drive and/or guidance of runner 6. The surface layer may often be, for example, rubber, cork, an elastomer plastic, or the like.

In FIG. 4 there is turnably borne parallel to the axis of the working roller 10 a reverse winding roller 12 housed in a casing 13, which is secured to the machine frame 14. The drive of the working roller (not represented in detail) is coupled with the drive of the reverse winding roller 12 through toothed belt 15 or other suitable means. Belt pulleys 16 and 17 mounted on working roller 10 and reverse winding roller 12 respectively, are matched to one another in such a way that the ratio of the number of revolutions (RPM) of the working roller to the number of double strokes per unit of time of runner 6 is an integer. Thereby it is assured that cutting means 8 fastened to a runner 6 is always guided over the same path curve on surface 11 of the working roller. In the example illustrated in the drawing, runner 6 consists likewise of a shuttle body 7, which is driven, however, by reverse winding roller 12. Guide plate 9 is transversely movable in slide 4 formed in casing 13. Cutting means 8 is interchangeably secured to runner 6. Due to the interaction of the runner driven by the reverse winding roller 12 with the surface 11 of the working roller 10, a single path curve is gradually incised into this elastic surface layer by the cutting means 8. The resulting winding groove can, however, also be cut from the outset in the surface of the working roller in order to avoid any initial straining of the cutting blade due to frictional forces between it and surface 11 acting on the runner.

Figure 5:
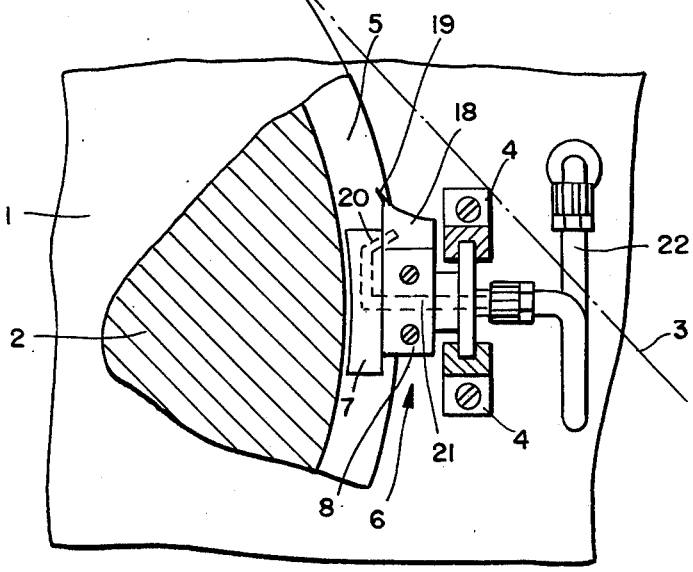
FIG. 5 is an enlarged detailed view of a portion of the structure shown in FIG. 2.

FIG. 5 shows in detail the cutting means 8 cooperating with the working roller 2. This representation corresponds approximately to those of FIGS. 1 to 3. Shuttle body 7 to the runner 6 acts—as described earlier—in cooperation with a guide groove 5 incised in working roller 2. Upon rotation of working roller 3, runner 6 is traversed or moved back and forth parallel to the axis of the working roller. On shuttle body 7 there is interchangeably secured a cutting blade 8 with a blade edge 18 facing the running direction. The projecting portion 19 of the blade edge 18 is wedge-shaped and preferably blunted in order to extend under the winder so as to lift it off of the surface of the working roller before it is severed. The blunted, projecting portion 19 of the blade edge 18 extends, for this purpose, slightly into guide groove 5 and beneath the surface of working roller 2.

In the embodiment according to FIG. 5, air nozzle 20 is mounted adjacent to cutting means 8, through which there is generated an aimed air flow, preferably in the direction of the running-off thread. Nozzle 20 is connected through a channel 21 provided in the runner 6 and a flexible hose 22 to a compressed air source (not represented in detail) in a suitable manner. In operation, air flows steadily from nozzle 20, and the loose end of the severed winder is engaged by the air stream and blown in the direction of the running-off thread cable which engages it and carries it along through the machine.

Figure 6:
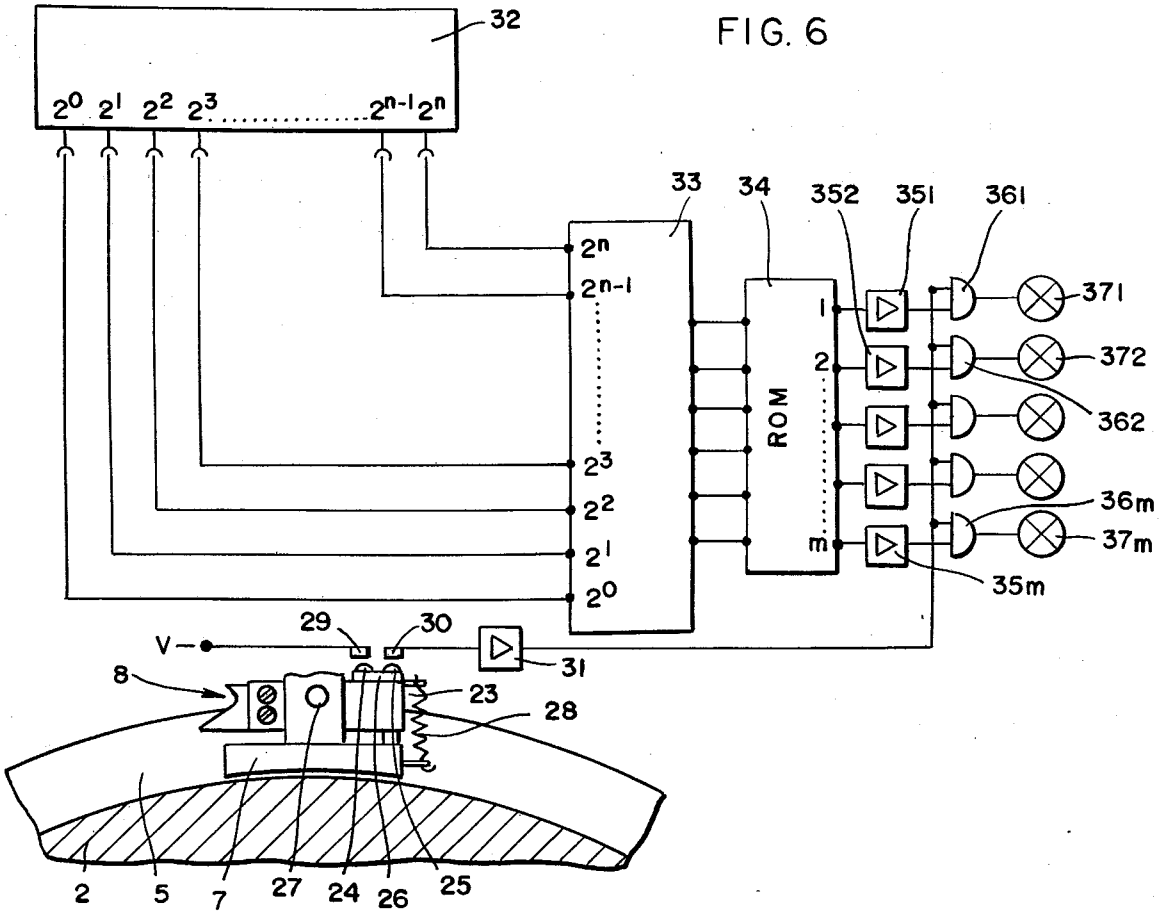
FIG. 6 is an enlarged detail view similar to FIG. 5 showing an alternate embodiment of the present invention.

In FIG. 6 there is shown a cutting means 8 constructed as a contactor which is connected to shuttle body 7 which is guided in guide groove 5 of working roller 2. The cutting means 8 consist of a blade holder 23 and an interchangeable cutting blade. Blade holder 23 may be injection-molded of a suitable plastic and carries on its end away from the cutting blade two contacts 24 and 25 which are arranged a slight distance apart on a contact bridge 26 for good electrical conductivity. In operation, the cutting blade of cutting means 8 will be moved in rotary joint 27 with respect to the shuttle body 7, which will cause contacts 24 and 25 to briefly close an open contact circuit as is shown. After the severing of the winder, spring 28 will restore the cutting means 8 to its starting position and the briefly closed circuit is again interrupted. The contacts 29 and 30 of the contact circuit are arranged in a suitable place with respect to the slide guide, parallel to the axis of the working roller 2. Contact 29 carries a suitable low voltage which, on closing of the contacts 29, 30 by contacts 24, 25 and bridge 26, is amplified by amplifier 31 and is applied to the elements 361, 362 — to 36m of the circuit shown.

While, through the above described contact circuit, it is possible to indicate, signalize or register that a winder has appeared and been cut on the working roller 2, the rest of the electrical circuit as shown serves the purpose of allocating the detected winder to a discrete thread 3. For this purpose, on the face of the working roller there is provided an angular coding disk (not shown), by which it may be determined the change of rotary angle of the working roller 2. The operation of such angle coding disks with Hall generator scanning or electro-optical angle coders is well known (see Siemens-Zeitschrift 45 (1971), No. 4, pp. 259/260, house organ of the firm of TWK-Elektronik, Dusseldorf). Therefore, a further description of its operation is not required.

The angle coding disk is driven by the shaft of the working roller and preferably a transmission is applied in between the rotational speed (RPM) of the working roller and the rotational speed of the angle coding disk, if the length of the guide groove 5 of working roller 2, or the length of the reverse thread roller 12, is so great that there are present one or more crossing sections of the reverse thread. The reason for this is that a clear and unambiguous allocation between the length coordinate and the angular coordinate of the reverse thread has to be provided, and a particular angular coordinate must belong only to a single length coordinate of the roller. In the event that the reverse thread extends over more than one circumference of the working roller, it is ncessary to determine the appertaining angular coordinates beyond 360°. The preferred solution for this problem is a correlation of the measured angular coordinates with the transmission ratio between the working roller and the angle coding disk.

The angle coding disk registers the angle changing of the working roller 2. The angle coder 32 transforms the measured angle changing into binary output signals by a circuit according to FIG. 6. These signals are electronically processed and evaluated by an allocator circuit 33 connected with the binary angle coder 32, and transformed via a demultiplexer (code transformer) 34 into discrete electrical pulses. Through the allocator circuit 33 (ROM; read only memories) the input signal from the binary angle coder 32 is evaluated and a determination is made of the length coordinate corresponding to the angle of the working roller, or the corresponding location of a discrete thread is computed with the aid of the Demultiplexer 34. The outputs 1, 2 to m of the Demultiplexer 34 are switched into "And" gates 361, 362 . . . 36m. after they are amplified by amplifiers 351, 352 . . . 35m. In the determination of the precise location of a winder on the working roller 2, there is provided, according to a discrete And gate, on the one hand the current of the contact current circuit and, on the other hand, the current pulse of the Demultiplexer 34. The current is switched through and a suitable arrangement 371, 372 . . . to 37m, which may be a signal lamp, counting mechanism or the like, is operated. In this manner, the number and discrete thread locations of winders which are cut during yarn handling operation may be automatically determined.

While particular embodiments of the present invention have been shown and described, it should be understood that various changes and modifications thereto may be made, and it is therefore intended in the following claims to include all such modifications and changes as may fall within the true spirit and scope of this invention.

What is claimed is:

1. A device for eliminating yarn laps from the surface of a rotating working roller, said device comprising:
   - a runner movable within a guide parallel to the axis of the working roller;
   - a means for cutting winders mounted on said runner,
   - a means for driving said runner within said guide whereby said cutting means is guided over the surface of said working roller; and
   - a means for coupling said rotating working roller to said runner driving means.

2. The device according to claim 1 wherein said runner drive means comprises a reverse-winding roller.

3. The device according to claim 2 wherein said coupling means comprises a closed linkage between said working roller and said reverse winding roller which drives said runner in a doublestroke traverse movement across the surface of said working roller, and wherein the ratio of the number of revolutions of the working roller (RPM) in respect to the number of the double strokes per unit time is an integer.

4. The device according to claim 1 wherein said working roller has a guide groove formed in its surface.

5. The device according to claim 4 wherein said runner is driven back and forth in a slide parallel to the axis of said working roller by said guide groove formed in the surface of said working roller.

6. The device according to claim 1 wherein said cutting means comprises a wedge-shaped blade edge facing said working roller running direction having a blunted projecting portion which extends slightly below the surface of said working roller and first engages any winder encountered thereon.

7. The device according to claim 1 further comprising an air nozzle mounted adjacent to said cutting means through which there is generated an aimed air flow in the direction of the running-off thread which removes the cut winder from the surface of said working roller.

8. The device according to claim 1 wherein said runner further comprises a means for detecting winders.

9. The device according to claim 8 wherein said cutting means is secured to said runner by means of a rotary joint and a spring and has electrical contacts positioned thereon which close an electrical circuit whenever a winder is cut.

10. The device according to claim 9 further comprising a means for generating an electrical pulse whenever said electrical circuit is closed whereby the number of winders cut is counted or otherwise signalized.

11. The device according to claim 10 further comprising a means for allocating said electrical pulses to discrete length sections of the working roller.

* * * * *